United States Patent [19]

Van Iperen et al.

[11] Patent Number: 4,903,493

[45] Date of Patent: Feb. 27, 1990

[54] HEAT SINK PROTECTIVE PACKAGING FOR THERMOLABILE GOODS

[75] Inventors: Willem H. P. Van Iperen, Westfield; Edmund B. Wilson, III, Randolph; Robert S. Golabek, Jr., Towaco, all of N.J.

[73] Assignee: PyMaH Corporation, Fairfield, N.J.

[21] Appl. No.: 297,879

[22] Filed: Jan. 17, 1989

[51] Int. Cl.[4] ..... B65B 63/08

[52] U.S. Cl. ..... 62/60; 62/4; 62/78; 62/457.9; 206/306; 252/70

[58] Field of Search ..... 62/4, 60, 78, 457; 252/67, 70; 206/306

[56] References Cited

U.S. PATENT DOCUMENTS

| | | | |
|---|---|---|---|
| 780,352 | 1/1905 | Kafka | 206/306 |
| 2,289,060 | 7/1942 | Merkle | 62/60 |
| 2,302,639 | 11/1942 | Moore | 62/60 |
| 2,315,425 | 3/1943 | Hill et al. | 206/306 |
| 2,677,243 | 5/1954 | Telkes | 206/306 |
| 2,677,664 | 5/1954 | Telkes | 252/70 |
| 2,808,494 | 10/1957 | Telkes | 62/4 |
| 2,856,506 | 10/1958 | Telkes | 219/39 |
| 2,989,856 | 6/1961 | Telkes | 62/371 |
| 3,236,206 | 2/1966 | Willinger | 119/3 |
| 3,379,025 | 4/1968 | Donnelly | 62/4 |
| 3,463,161 | 8/1969 | Andrassy | 128/402 |
| 3,986,969 | 10/1976 | Telkes | 252/70 |
| 4,003,426 | 1/1977 | Best et al. | 165/53 |
| 4,049,408 | 9/1977 | Patel | 62/4 |
| 4,081,256 | 3/1978 | Donnelly | 62/4 |
| 4,152,899 | 5/1979 | Herrick | 62/4 |
| 4,187,189 | 2/1980 | Telkes | 252/70 |
| 4,237,023 | 12/1980 | Johnson et al. | 252/70 |
| 4,250,866 | 2/1981 | Telkes | 126/116 A |
| 4,425,998 | 1/1984 | Hof et al. | 206/306 |
| 4,752,310 | 6/1988 | Maier-Laxhuber et al. | 62/4 |

OTHER PUBLICATIONS

"Solubilities of Inorganic and Metal Organic Compounds" by A. Seidell and W. F. Linke, American Chemical Society, Washington, D.C., 1965.

"Thermochemistry of Salt Hydrates", N.T.I.S. Report P.B. No. 227,966, (1973), on pp. 71–79.

*Primary Examiner*—Ronald C. Capossela

*Attorney, Agent, or Firm*—Scully, Scott, Murphy & Presser

[57] ABSTRACT

There is disclosed an improved heat sink composition and a method for preparing said composition to protect thermolabile goods from degradation or destruction from high temperatures. A representative composition includes sodium sulfate, sodium sulfate decahydrate (also known as Glauber's salt) and fumed silcon dioxide, a hydrophilic suspension agent which maintains the excess anhydrous sodium sulfate in uniform suspension when the composition is in a liquid state. In a preferred embodiment, the salt prior to use is dissolved in water, and driven to saturation, the hydrophilic agent is added, and the suspension driven to an over saturated state by the additional of from 1 to 30% anhydrous salt. The composition is then sealed in a plastic container of the desired shape to form an improved heat sink. The goods to be protected are packaged with the heat sink, whose salt hydrate has a melting point about 3° C. to about 5° C. lower than the thermosensitive temperature of the goods to protect them when the temperature of the environment exceeds the temperature of the goods. In the preferred embodiment, the goods and heat sink are surrounded with a layer of insulation which is adjacent to the outside container, which may be made of cardboard, paper, plastic and/or wood.

17 Claims, 7 Drawing Sheets

"500 A" SHIPPER 1/2 SIZE
(9"X9"X9 1/4")

PHASE DIAGRAM : SODA ASH / WATER

HEAT SINK PROTECTIVE PACKAGING FOR THERMOLABILE GOODS

FIELD OF THE INVENTION

The present invention relates to a method of protecting thermolabile goods from degradation if the goods happened to be subjected to high temperatures.

REFERENCE TO RELATED APPLICATIONS

The subject matter of the instant invention is related in part to U.S. Pat. No. 4,425,998, which issued on June 14, 1984 to the assignee of the present invention and the prior applications cited therein.

BACKGROUND OF THE INVENTION

1. Field of the Invention

This invention relates to the protection of temperature-sensitive material with insulation and heat sink compounds.

2 Description of the Prior Art, and Other information

Many items of commerce are subject to degradation or destruction by excessively high temperatures, e.g., single-use clinical thermometers, irreversible temperature indicators, food, and enzymes, antigens, antibodies, or protein substances used in immunoassays or agglutination tests, and other biological or organic substances such as vaccines, sera, etc. Exposure of clinical thermometers for example, to temperatures above 96° F. will cause them to "fire", i.e., to record the exposed temperature and become unusable for further temperature measurement. Products such as clinical thermometers are presently shielded from the adverse effects of high shipping and storage temperatures through heavily insulated shipping cartons containing a "salt foam" formed with sodium sulfate decahydrate as a heat sink material with a relatively high latent heat of fusion.

U.S. Pat. No. 4,425,998 discloses a shell within a shell construction, wherein a 1" to 2" foam insulating shell surrounds and protects an inner shell of "salt foam" having a high latent heat of fusion. The "salt foam" was prepared by melting a compound of sodium sulfate, absorbing the solution into an open cell foam such as phenol-formaldehyde, containing the solution and foam within a polyethylene bag and cooling the solution to form sodium sulfate decahydrate, also known as Glauber's salt. By providing enough insulation to provide a rate of heat transfer through the insulation that is lower than the rate of heat absorption by the compound, a synergistic effect was obtained which significantly extended the period of time in which the thermolabile goods were protected within the carton. While this construction was effective for a single cycle, upon melting and resolidifying, part of the sodium sulfate precipitated out of solution as a particulate sediment, leaving a dilute solution above, which never completely resolidified. In addition, because of the concentrations involved, the solution would partially resolidify as a mixture of sodium sulfate solution and sodium sulfate decahydrate, with multiple incongruent melting points, which adversely effected the performance of the salt foam.

U.S. Pat. No. 4,237,023 to Johnson, et al. discloses an Aqueous Heat Storage Composition Containing Fumed Silicon Dioxide and Having Prolonged Heat-Storage Efficiencies. One of the phase change salts disclosed by this patent is sodium sulfate decahydrate.

U.S. Pat. Nos. 4,187,189; 3,986,969; 2,989,856 and 2,677,664 all issued to Maria Telkes disclose a variety of sodium sulfate decahydrate compositions, one of which, disclosed in 3,986,969 uses a nucleating agent such as borax and a thixotropic agent such as hydrous magnesium aluminum silicate (attapulgus clay) to form a gel like suspension having a heat of fusion of more than 50 BTUs per pound (28 cal/gm).

"Solubilities of Inorganic and Metal Organic Compounds" by A. Seidell and W. F. Linke, American Chemical Society, Washington, D.C., 1965 complies a number of phase diagrams of salt hydrates and other systems from which high latent heat of fusion materials may be selected. Some of these are also set forth in "Thermochemistry of Salt Hydrates", N.T.I.S. Report P.B 227966 (1973) on pages 71–79.

OBJECTS OF THE INVENTION

It is an object of the present invention to provide an improved heat sink composition for protecting thermolabile goods having an enhanced latent heat of fusion and superior performance characteristics.

It is another object of the present invention to provide an improved heat sink composition for protecting thermolabile goods that permits ready shipping of the goods to be protected because the composition remains in non-segregating form at shipping temperatures, even though exposed to repetitive cycles of 100° F. to 120° F. heat that may be experienced in a normal summer shipping environment.

It is another object of the present invention to provide an improved method for protecting thermolabile goods wherein protection is provided by the ability of the chemical to absorb heat at a rate sufficient to protect the goods when the temperature of the environment exceeds the melting point of the chemical.

It is another object of the present invention to provide a method for making the composition that drives a mixture of salt and water into its maximum hydrate configuration to thereby consistently obtain the composition with the most desirable latent heat of fusion.

SUMMARY OF THE INVENTION

The present invention is directed to a composition and a method for preparing the composition (and a container to employ said composition) for protecting thermolabile goods from degradation or destruction by thermosensitive temperatures, particularly excessively high temperatures, by surrounding the goods with a composition having a melting point slightly less than the thermosensitive temperature of the goods and the capacity to absorb heat at a rate sufficient to protect the goods when the temperature of the environment exceeds the melting point of a compound. By "thermosensitive temperature", we mean the temperature at which a given property or characteristic of a substance to be protected begins to be affected in a discontinuous or abrupt or predetermined manner as a function of temperature, e.g., it may be a melting point, a freezing point, a temperature at which the property or characteristic is affected by relatively short exposure (almost instantaneously for thermometers) to degradation or deterioration. By "slightly less" we mean a temperature commencing from about 1° C. to about 20° C. below the thermosensitive temperature, and in special circumstances even many degrees below the thermosensitive temperature, as will be described, infra.

Preferably, the melting point of the composition protecting the thermolabile goods is from about 3° C. to about 10° C. and most preferably, from about 3° C. to about 5° C. less than the thermosensitive temperature of the thermolabile goods being protected.

The present invention provides an improved hydrate composition that remains in solid form, and in one portion of the salt-water phase diagrams, rather than shifting its composition in response to temperature cycles and partial melting.

By utilizing a hydrophilic bonding agent to maintain excess anhydrous salt equally dispersed within a saturated solution, a pre-selected salt hydrate and salt composition will always be formed when the solution-slurry is cooled.

Because of the nature of sodium sulfate and its multiple hydrate forms, as illustrated in the phase diagrams, a saturated solution of sodium sulfate, when cooled, will always form solution and sodium sulfate decahydrate, until the solution is cooled to ice. Further, since a drop in temperature results in a decrease in solubility for the system, it is believed that additional decahydrate molecules are "disassembled" to provide $H_2O$ molecules for the saturated solution as the sodium sulfate emerges from solution. This provided for partial melting and an undesirable slope to the "heat sink" temperature curve provided by the prior art salt foam. In addition it was impossible to rid the system entirely of solution, since the addition of excess sodium sulfate caused precipitation and settling of the precipitate. In shipping, use of this salt hydrate resulted in stratification, with the precipitate settling to the bottom and saturated solution surrounding the precipitate and decahydrate form.

The present invention provides a method for driving excess anhydrous sodium sulfate into the sodium sulfate solution to create a slurry in which the anhydrous crystals are evenly suspended throughout the solution so that when cooled, the excess precipitate is locked into the decahydrate crystal. This enables the improved "heat sink" of the present invention to be packaged as a hard solid, with a high percentage by weight of sodium sulfate decahydrate in the composition. The temperature curve for this improved "heat sink" thus remains essentially flat, i.e. exhibiting essentially isothermal melting at the desired protected temperature until the latent heat of fusion for the entire mass is exhausted, at which time the mass turns to a non-segregating composition. Further, because of the hydrophilic suspension agent employed, the crystalline anhydrous sodium sulfate does not settle out, and the composition does not stratify. Thus, the improved composition can be used over and over again, rather than being essentially limited to a single use.

The suspension may also be poured into different shaped containers and solidified in any desired shape for the protective packaging.

Finally, it has been found that with the improved composition it is no longer necessary to completely enclose the protected goods with the hydrate composition as was necessary with the prior art "salt foam". The improved composition may be formed as a heat sink adjacent to the protected goods with the goods and heat sink surrounded by insulation. This means the resultant package can be simplified, and the size of the "salt foam" panels reduced. Because the heat absorption capacity is improved, it is also possible to use a higher, and thus cheaper, K value foam insulation to surround and protect the goods.

In one of the preferred embodiments, the method surrounds the improved heat sink composition with a layer of outer insulation which is adjacent to an outside container, which container may be made of cardboard, paper, plastic, and/or wood.

DESCRIPTION OF THE DRAWINGS

FIG. 1(*b*) is a diagramatic view of the prior art "salt foam" panel after the sodium sulfate decahydrate has partially melted.

DETAILED DESCRIPTION OF THE PREFERRED EMBODIMENTS

Figure 1A:
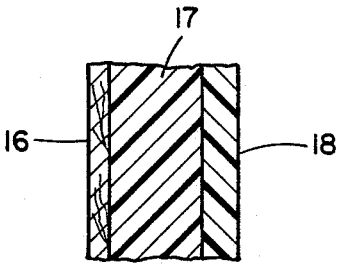
PRIOR ART FIG.1(a)
FIG. 1(*a*) is a cross-section of the prior art container described in U.S. Pat. No. 4,425,998.
Figure 1B:
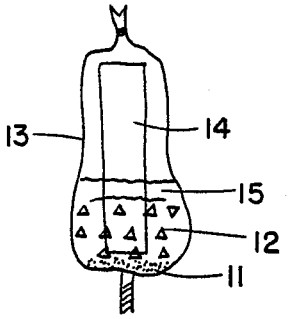
PRIOR ART FIG.1(b)

It has been discovered, unexpectedly, that protective packaging of heat labile goods can be greatly improved by using heat sinks formed with certain salts, notably sodium sulfate decahydrate, e.g. Glauber's salt, as the refrigerant. Glauber's salt acts as a refrigerant as follows: the melting point of Glauber's salt is 32.38° C. A clinical thermometer such as described in U.S. Pat. Nos. 4,189,942, 4,232,552 and 4,345,470 begins to indicate temperature at 35.5° C. When the clinical thermometers are packaged with a heat sink of the improved composition utilizing Glauber's salt and exposed to high temperatures, for example 50° C., the temperature of the heat sink rises until it reaches 32.38° C. At that temperature, the Glauber's salt begins to melt and absorb heat (energy) at a capacity of about 54 cal/gram (17 kcal/mole) of the sodium sulfate decahydrate. The package will remain at about 32° C. until the salt hydrate has been melted. Typically the prior art package, as illustrated in FIG. 1(*a*) included a fiber board or corrugated box 16 on the outside, an intermediate layer of insulating foam 17, and an interior layer of "salt foam" 18.

The rate of thermal conduction through any material including insulation, is directly proportional to the difference in temperature on either side of the material or insulation. By selecting a salt hydrate with a melting point near the temperature to be protected, the "heat sink" protection of the hydrate is reserved until ambient temperature actually exceeds the melt temperature, and then the rate of heat flow is minimized since the temperature differential is minimized. When ice is used as refrigerant in an exposure to 100° F., the difference in temperature is 68° F. With Glauber's salt, however, the difference in temperature is only 10.4° F. (100° F.–89.6°

F.). Thus, the rate of heat flow with Glauber's salt is less than 1/6 the rate of heat flow with ice as refrigerant. The result of the differences in temperature and heat of fusion between Glauber's salt and ice is that one pound of Glauber's salt will preserve the goods in the package as well as 4.5 pounds of ice during exposure to 100° F. Therefore, if a compound such as Glauber's salt is employed alone, it is employed in such a calculable effective amount to protect the contents, i.e., in an amount effective as to absorb a given amount of heat in a given environment having an ambient temperature sufficient to protect the contents for a predetermined amount of time.

For the application of preserving single-use thermometers, sodium sulfate decahydrate, sodium carbonate decahydrate or calcium chloride hexahydrate are well suited. Other thermally labile goods or applications may require alternate salts or compounds, some of which are listed below:

| Hydrates | Melting Point (°C.) | Heat of Fusion (kcal/mole) |
|---|---|---|
| $Ca(NO_3)_2.4H_2O$ | 47 | 8.13 |
| $Na_2HPO_4.12H_2O$ | 35.5 | 23.9 |
| $Na_2S_2O_3.5H_2O$ | 48 | 5.6 |
| $Zn(NO_3)_2.4H_2O$ | 45.5 | 9 |
| $Fe(NO_3)_2.6H_2O$ | 60 | 8.5 |

As previously mentioned, the salt hydrate should be selected as one having a melting point about 3° C. to about 5° C. below the labile temperature, or the thermosensitive temperature of the goods. The amount of refrigerant is dependent upon the thickness of insulation and surface area/volume ratio of the package, the amount of time and the temperature for which the goods need protection.

While the use of the above hydrated salts has many advantages, there are some minor problems. First, unless cast into a solid block, the salt hydrates are generally formless powders which can be difficult to handle. Further, upon melting, they form liquids which are free to flow into new geometrics within their container, if flexible, and thereafter separate or stratify.

The prior art "salt foam" was formed by absorbing a saturated solution of sodium sulfate into a bibulous material such as open cell foam, paper, natural or synthetic sponge and the like, sealing the sodium sulfate and strata in a flexible plastic bag to exclude contamination and water vapor exchange, and then cooling the bag below the fusion point of sodium sulfate decahydrate.

Figure 6:
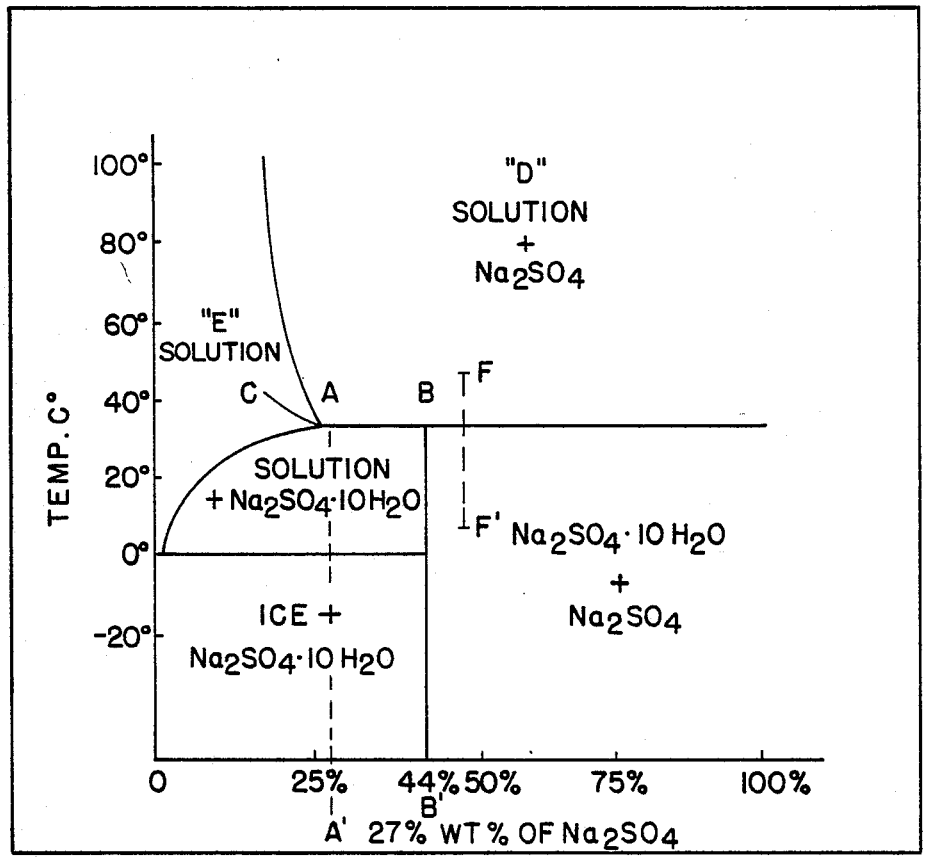
FIG. 6 is a phase diagram of sodium sulfate and water.

The prior art salt foam, when so packaged, was easy to handle, and prevented the salt from sagging from its intended location within the package during shipment and the first phase change. However, as illustrated in FIG. 1(*b*), multiple phase changes or "melts" resulting from reuse of the "salt foam" panel would result in stratification of the sodium sulfate, with excess sodium sulfate precipitate 11 on the bottom, followed by solidified sodium sulfate decahydrate 12 in the middle of the pouch or bag 13. The bag 13 would be bulged by liquid solution 15 that was no longer fully saturated. Repeated phase changes only enchanced the stratification and sedimentation. The reason for the stratification may be found in the phase diagram for sodium sulfate and water, as illustrated in FIG. 6. If a totally saturated solution is prepared, the maximum saturation is at point C at 32.383° C. and approximately 29% by weight of sodium sulfate. The addition of more sodium sulfate results in a crystalline or precipitated form of anhydrous sodium sulfate in the solution-solid phase mixture. If this solution is then poured into the formaldhyde foam, and allowed to cool along A–A', illustrated in FIG. 6, then sodium sulfate decahydrate will be formed, together with a sodium sulfate solution. Section line B–B' is a 44.1% boundary, representing the stoichiometric sodium sulfate decahydrate compound, beyond which the salt system crystalizes as sodium sulfate decahydrate and anhydrous sodium sulfate. Regardless of whether 29% is used, as was the case with the prior art salt foam, or whether 44% is used, as suggested by the prior art Telkes references, when the system is heated above the transition temperature of 32° C. and the latent heat is absorbed, then a solution of sodium sulfate having crystals of anhydrous sodium sulfate therein is formed as indicated in the upper right section "D" of the phase diagram illustrated in FIG. 6. The anhydrous sodium sulfate is denser than the solution and it settles as a stratified layer 11 illustrated in FIG. 1(*b*). When the system is again cooled, sodium sulfate decahydrate will be formed from the solution, but the system is shifted to the left on the phase diagram since not all of the anhydrous sodium sulfate particles will be able to attract the waters of hydration when they are concentrated together at the bottom of the container. Each succeeding cycle will reduce the total weight of anhydrous sodium sulfate in the solution-solid phase, until solution only is reached as indicated by the upper left portion "E" of the phase diagram in FIG. 6. At this point, reducing the temperature reduces the solubility of the sodium sulfate system, so that repeated cooling of the solution results in even more precipitation of excess sodium sulfate.

The prior art has suggested the use of suspension agents, i.e. CAB-O-SIL (fumed silicon dioxide) or hydrous magnesium aluminum silicon (attapulgus clay) to maintain the sodium sulfate evenly suspended within the solution when the system is in its melted state. In addition, nucleating agents are added to ensure that the system resolidifies as sodium sulfate decahydrate, rather than undercooling.

By overdriving the anhydrous sodium sulfate into the system together with a hydrophilic suspension agent, an improved composition may be formed.

Figure 5:
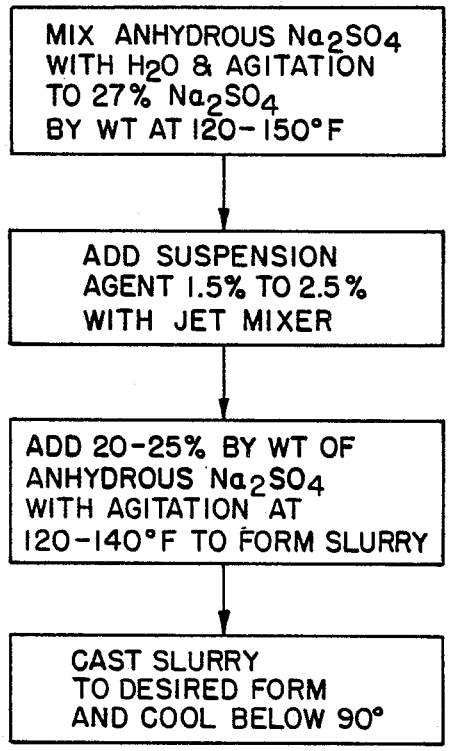
FIG. 5 is a simplified flow chart of the method of making the improved composition, when sodium sulfate decahydrate is the desired salt hydrate.

As illustrated in FIG. 5, the improved composition is presently formed by first mixing 200 lbs. of anhydrous sodium sulfate with 60 gallons of water and agitation to create an aqueous solution which is approximately 26% by weight, sodium sulfate. The water is preheated to 120° to 150° F., and normally 145° F. After the saturated solution-slurry has been formed, 16 pounds of a hydrophilic suspension agent such as CAB-O-SIL, by Cabot Corporation (fumed silicon dioxide) is then added to the solution with a gentle, low shear agitation, such as that imparted by a jet mixer, to achieve a total weight of 1.5 to 2.5% in the final composition. After the CAB-O-SIL has been evenly dispersed, an additional 340 lbs., or 20 to 25% by weight of anhydrous sodium sulfate is added with agitation at 120° to 140° F. to form a slurry that is approximately 51% by weight of sodium sulfate. This slurry may then be cast into any desired form, and then cooled below 90° to form sodium sulfate decahydrate, with evenly dispersed finely divided crystalline anhydrous sodium sulfate particles therein. Nucleation agents are no longer necessary. The resulting composition is a hard white crystalline block of decahydrate salt and sodium sulfate crystals interlinked together by hydrogen bonding with the long chain fumed silicon dioxide hydroxyl groups The improved composition also results in a superior performance, having approximately twice the heat absorption characteristics of the prior art "salt foam." It is estimated that the latent heat of the improved composition is approximately 83 BTU per pound (46 cal/g).

Several suspension agents were tested including aluminum oxide, CAB-O-SIL M-5 (fumed silicon dioxide from the Cabot Corporation) sawdust, shredded newspaper, microcrystalline cellulose (Schliecher & Schuell), Jaguar C-13, Jaguar HP-8 and Jaguar A-40-F (guar gum agents from Stein-Hall ), Klucel Type L by Hercules Corporation, Kelco SCS LV (sodium cellulose sulfate from Kelco Corporation), Manitol Powder (J. T. Baker Chemical Co.) and Daxad 19 (W. R. Grace Company). These agents were tested first with sodium sulfate, and after selection of the CAB-O-SIL agent, were tested with other hydrate salts including sodium carbonate and calcium chloride.

The aluminum oxide Jaguar HP-8, Jaguar A-40-F, Klucel Type L, Kelco SCS LV, Manitol Powder and Daxad 19 were not satisfactory, and allowed sodium sulfate to settle out of solution.

CAB-O-SIL M-5, cellulose (sawdust, newspaper and microcrystalline cellulose) and Jaguar C-13 created a suspension which prevented the stratification and settling of the sodium sulfate It was found that the cellulose products created a suspension at approximately a 2% by weight level, but that the cellulose particles must be extremely small and kept at 100% relative humidity in order to not adversely affect the waters of hydration. Microcrystalline cellulose appeared to work the best of the cellulose group.

Jaguar C-13 and CAB-O-SIL M-5 appeared to be the most effective suspension agents, both creating a suspension at approximately 1.5% by weight when added to the sodium sulfate system. CAB-O-SIL M-5 would also offer the advantages of commercial availability, price per pound and of being able to vary the viscosity of the suspension by altering the amount of CAB-O-SIL added. 1.5% of CAB-O-SIL M-5 created a suspension, 2% created a viscous suspension, 2.5% created a very viscous suspension, and 3% created a plastic suspension, almost a paste. CAB-O-SIL M-5 is fumed silicon dioxide which is surface hydrophilic due to hydroxyl groups attached to some of the silicon atoms and is capable of forming hydrogen bonds with water. It forms a classic thixotropic suspension in water, since the hydrogen bonding is strong enough to create an interconnected network of silicon dioxide and water molecules. When subjected to a shear force, however, such as mixing or pouring, the weak hydrogen bonds are broken, and the suspension may be poured. Similarly, it is believed that the hydrophilic nature of CAB-O-SIL creates the same type of hydrogen bonding with the waters of crystallization that are bonded to the hydrate molecule, with the crystalline lattice hydrate bond being stronger than the hydrogen bond. The network suspends the particulate anhydrous sodium sulfate crystals in an even dispersion until cooling, and in some manner, not fully understood, promotes or enables the formation of the hydrate crystals, since the improved composition with 1 to 10% excess anhydrous salt solidifies readily when cooled into hydrate crystals, without the use of nucleating agents, and does not substantially undercool, a problem frequently noted and addressed in reversable phase systems.

Figure 7:
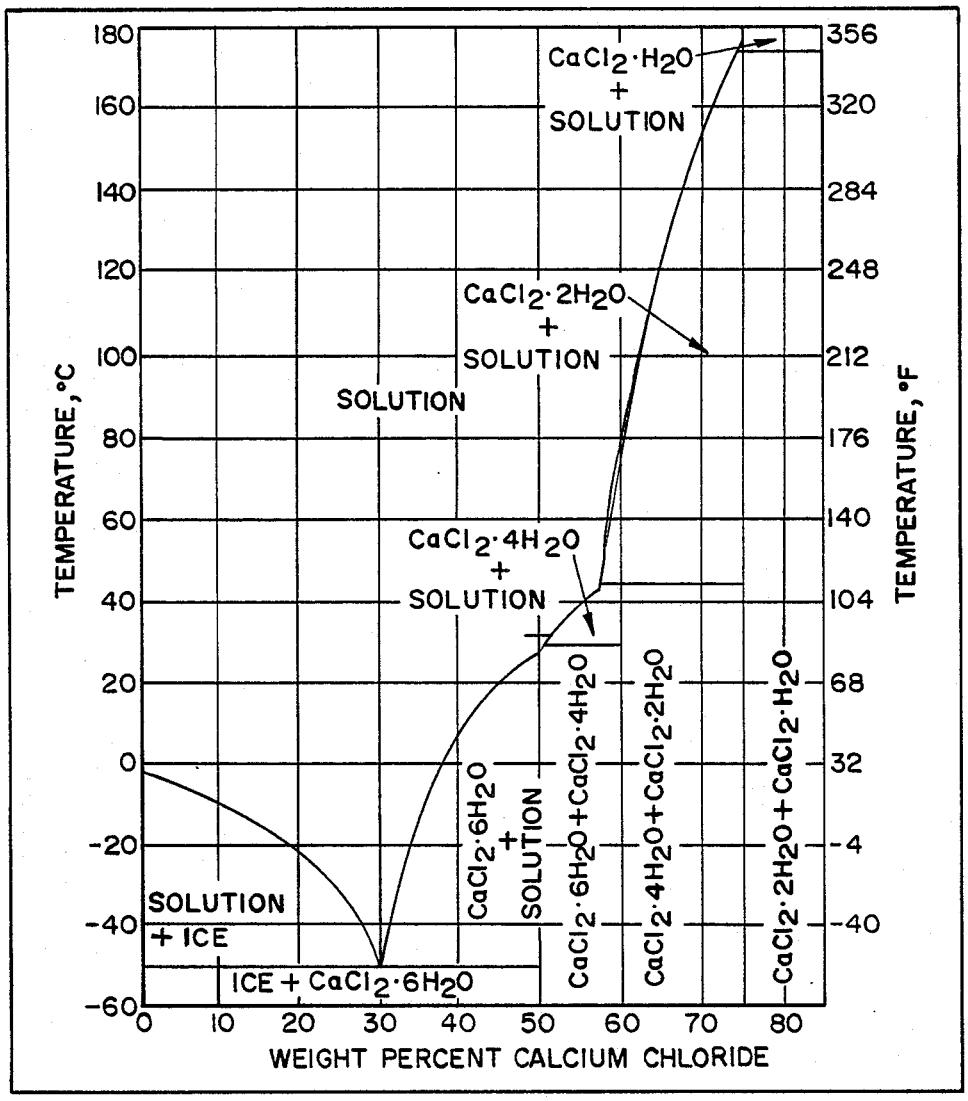
FIG. 7 is a phase diagram of calcium chloride and water, illustrating many of the hydrate forms thereof.

After selection of CAB-O-SIL M-5 as the preferred suspension agent, a number of salt phase systems were tested in addition to the sodium sulfate system. The preferred range for use of calcium chloride was 50–60% by weight of calcium chloride which forms a mixture of calcium chloride hexahydrate and calcium chloride tetrahydrate. These hydrates are formed at temperatures below 86° F., as indicated by the phase diagram for calcium chloride depicted in FIG. 7. Above 86° F., the calcium chloride hexahydrate is disassociated, and only calcium chloride tetrahydrate and solution are found. It should be noted that the use of CAB-O-SIL M-5 with a calcium chloride salt phase system resulted in a satisfactory system, with no appreciable undercooling, even without the use of nucleating or precipating agents. Calcium chloride does not have the same limitation of solubility addressed with respect to the sodium sulfate system. However, above 86° F., some calcium chloride tetrahydrate crystals remain suspended in solution, probably by hydrogen bonding to the CAB-O-SIL.

Figure 8:
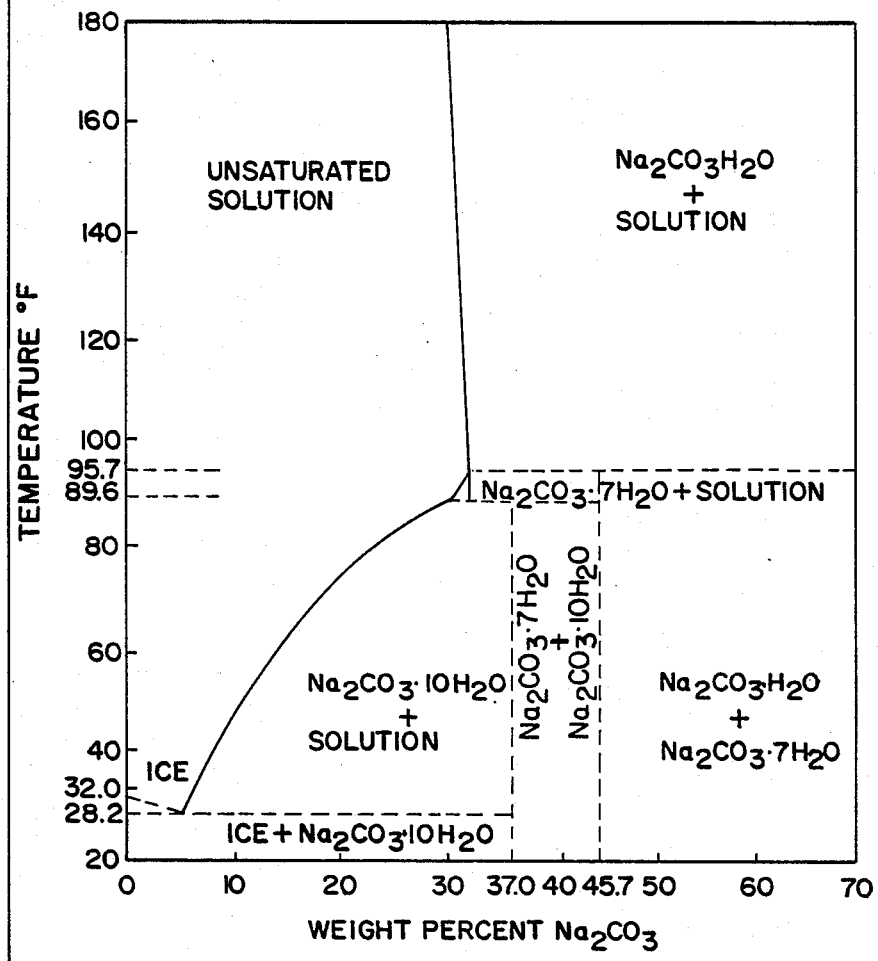
FIG. 8 is a phase diagram sodium carbonate and water.
Figure 9:
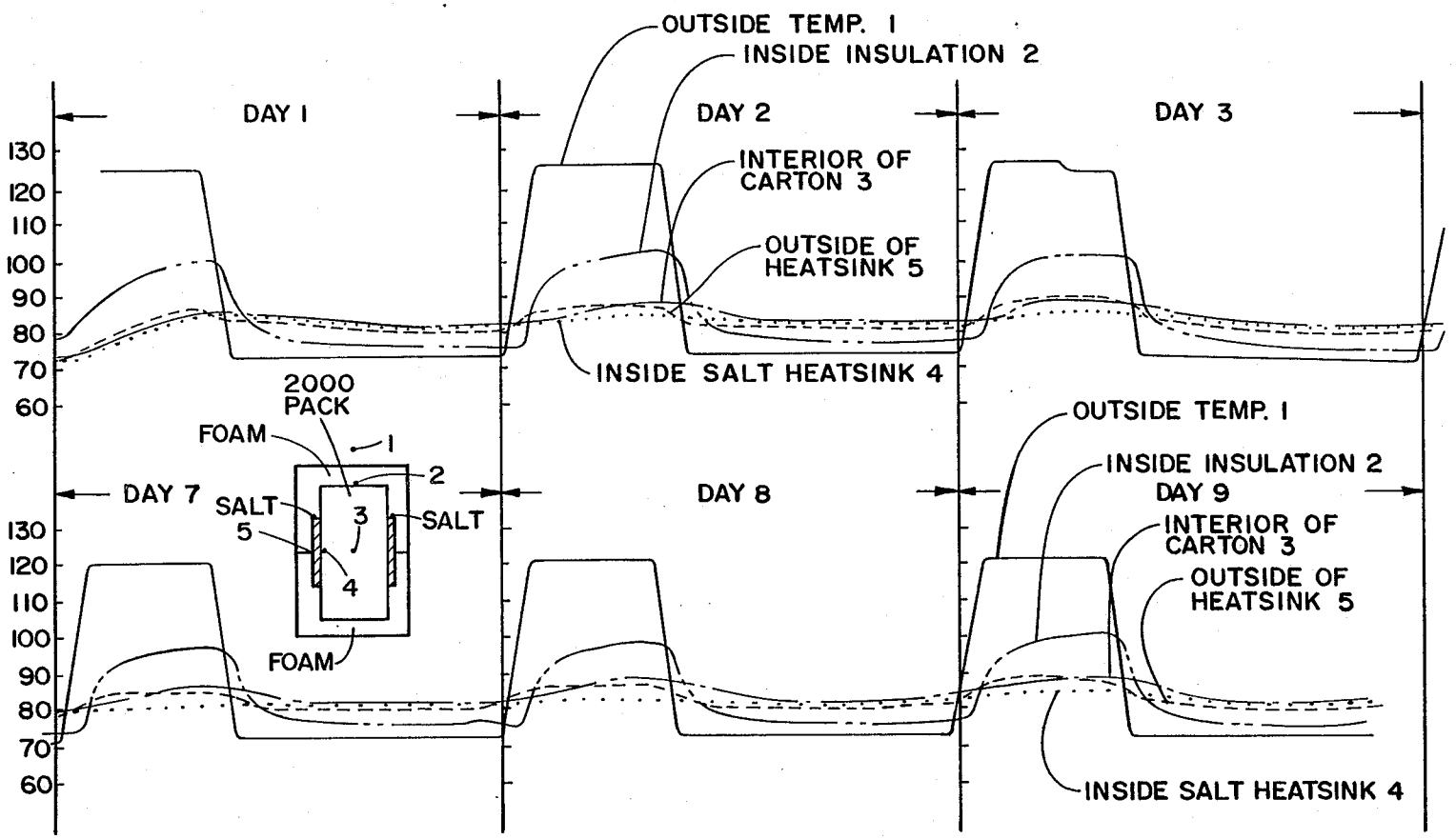
FIG. 9 is a portion of a printout of a time vs. temperature for a heat cycle test of the container illustrated in FIGS. 2 and 3.

Sodium carbonate was tested with and without CAB-O-SIL at 39% by weight and 75% by weight solutions. As indicated by the phase diagram depicted in FIG. 8, a 39% by weight system forms sodium carbonate decahydrate and sodium carbonate heptahydrate at temperatures below 89.6° F. At temperatures above 89.6° F., the decahydrate is disassociated in solution with the heptahydrate remaining. The heptahydrate releases its waters of hydration at 95.7° F. The sodium carbonate systems without CAB-O-SIL stratified and formed a layer of precipitated anhydrous sodium carbonate. The preferred composition for the sodium carbonate system is from 38–45% by weight of sodium carbonate, approximately 4% by weight of CAB-O-SIL and the remainder water.

Figure 2:
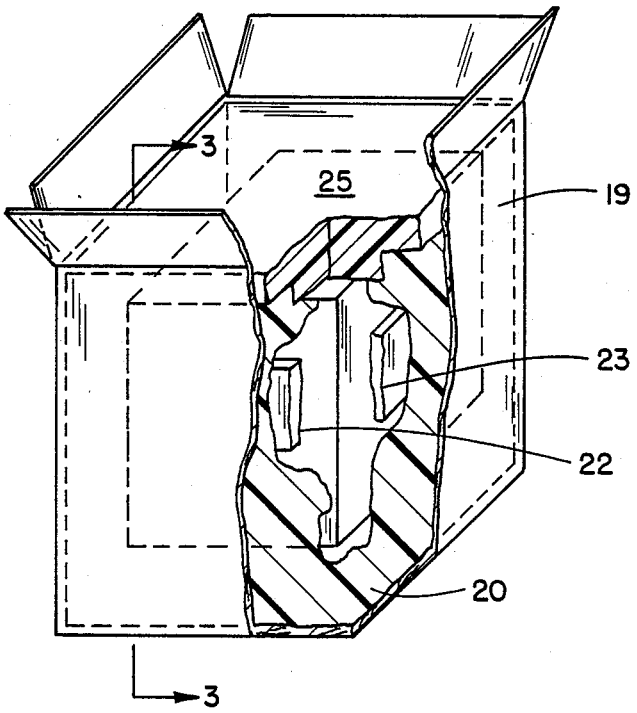
FIG. 2 is a partially cross-sectional view of an improved form of the container embodying the present invention.
Figure 3:
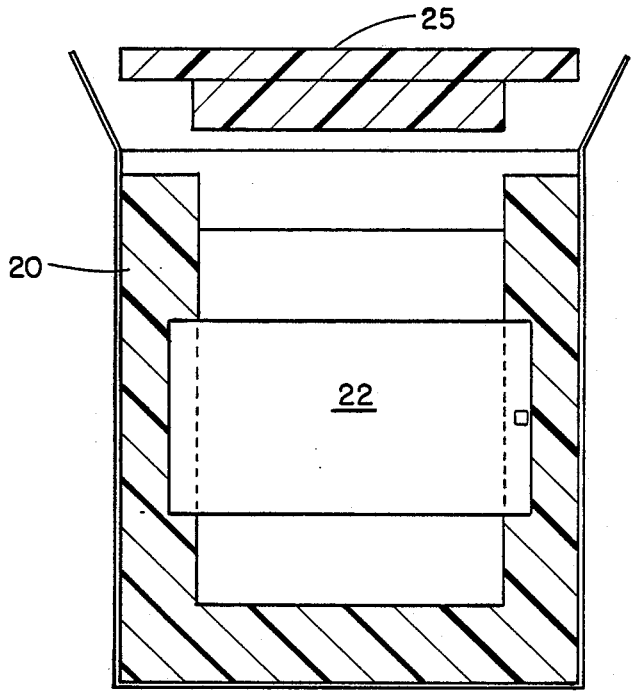
FIG. 3 is a partially cross-sectional view of the container illustrated in FIG. 2, taken along section lines 3–3'.
Figure 4:
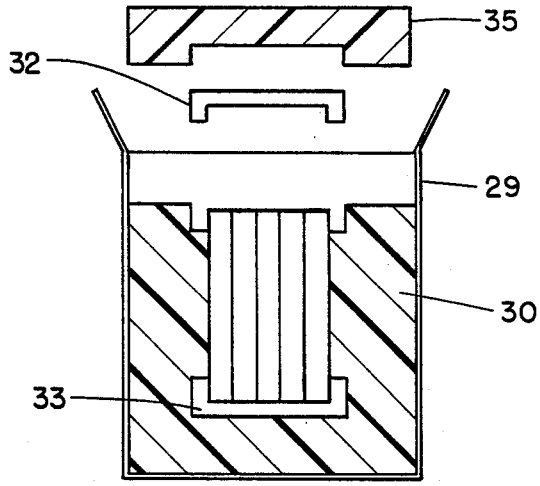
FIG. 4 is a partially cross-sectional view of an alternate embodiment of a container utilizing the present invention.

The improved composition of the present invention provides a superior performance that enables the use of higher K value (less expensive) foam and smaller quantities of the composition to achieve the same result. As illustrated in FIGS. 2–4, the shipping cartons of the present invention, when used to ship thermolabile thermometers, are formed with an outer layer of corrugated cardboard 19, 29, an intermediate layer of polyurethane foam 20, 30, and a salt bottles 22, 23, 32 and 33 positioned within in the carton and surrounding the heads of the thermolabile thermometers. Salt bottles 22 and 23 form a band of the heat sink composition which surrounds the heads of the thermolabile thermometers, with the thermometers being packaged heads in and tails out. Salt bottles 32, 33 define recessed cavities for receiving the heads of the thermometers packaged in the carton illustrated in FIG. 4. The salt bottles 22, 23, and 32, 33 are modular in nature and adapted to be configured to a variety of carton sizes as more fully described in my copending application U.S. Ser. No. 07/331/073, filed Feb. 14, 1989, entitled Improved Modular Heat Sink Package.

The package illustrated in FIGS. 2, 3 and 4 are formed with foam in place INSTAPAK-40F polyurethane, as sold by Sealed Air Corporation of Danbury, Conn. It has a K factor of 0.38. It is substantially lighter and less expensive than the foam utilized in prior U.S. Pat. No. 4,425,998 which was INSTAPAK-200, a polyurethane foam having a K factor of 0.15. In addition, with the improved composition of the present invention, it is no longer necessary to form a "shell within a shell" or to entirely surround the thermolabile product with the "salt foam" panels.

The present invention, as illustrated in FIGS. 2, 3 and 4 provides a band of the improved composition surrounding the critical portion of the thermolabile product, and both are placed within an insulated carton. Even though the insulation has a substantially higher K value, and there is less total sodium sulfate decahydrate within the carton, the improved package provides 50% longer protection than the package described in U.S. Pat. No. 4,425,998. In addition, because the improved sodium sulfate system is not stratified, the improved composition provides significantly longer protection when used in a real world environment. In normal shipping conditions, ambient atmospheric temperatures reach a maximum high at one to three o'clock in the afternoon, with a maximum low just before dawn. FIG. 4 illustrates six days of an nine day test utilizing the package illustrated in FIGS. 2 and 3. In this cycle test, the package was subjected to an eight hour cycle of 120° F. followed by a 16 hour cycle at 72° F. for a period of 9 days, and the temperatures were measured at a variety of points within the carton. During the nine days, the temperature within the band enclosed by the salt bottles never exceeded 90° F. The highest temperature recorded in the box, at a distance furthest from the improved salt composition was 97° F.

In other cycle tests, wherein the thermometers were subjected to cycles varying from a high of 120° F. to a low of 85° F. during the day, the critical temperature within the salt bottles did not exceed 93° F. until the eighth day of the test. Thus when subjected to repeated cycling, as present in a real world shipping environment, the improved composition of the present invention substantially out performed the prior art salt foam system.

With the improved composition of the present invention one may either (a) increase the K factor of the foam, provided the total insulation has a rate of heat transfer through the insulation which is less than the rate of heat absorption, (b) decrease the insulation thickness or (c) reduce the amount of salt composition within the package; or any combination thereof. In addition to the enhanced performance, the improved stability of the composition extends the service life of the package, when subjected to a cycling environment.

What is claimed is:

1. A method of protecting thermolabile goods having a thermosensitive temperature from high temperatures, said method comprising (a) packaging said thermolabile goods with a heat sink composition, said composition having a melting point slightly less than the thermosensitive temperature of said goods, said composition being enclosed in a container and consisting of a salt hydrate, a hydrophilic bonding agent and from 1 to 10 percent of this same salt in anhydrous form;

(b) surrounding said goods and said heat sink composition with a layer of insulation, said insulation having a rate of heat transfer through the insulation that is less than the rate of that absorbance by said heat sink.

2. The method of claim 1 wherein the goods are irreversible temperature indicators.

3. The method of claim 2 wherein the temperature indicators are single use thermometers.

4. The method of claim 1 wherein the heat sink composition has a latent heat capacity of at least 10 cal/g.

5. The method of claim 1 wherein the salt is selected from the group consisting of sodium sulfate, sodium carbonate and calcium chloride.

6. The method of claim 5 wherein the hydrophilic bonding agent if fumed silicon dioxide.

7. The method of claim 1 wherein the insulation is polyurethane foam.

8. The method of claim 1 wherein the heat sink composition has a melting point about 3° C. below the thermosensitive temperature of the goods.

9. A container for protecting thermolabile goods having a thermosensitive temperature, from high temperatures, said container comprising (a) a heat sink packaged adjacent said thermolabile goods, said heat sink being a container filled with a salt hydrate, a hydrophilic bonding agent and from 1 to 10 percent of the same salt in anhydrous form;

(b) a layer of insulation surrounding said goods and said heat sink, said insulation having a rate of heat transfer that is less than the rate of heat absorbance by the heat sink.

10. A container as claimed in claim 9 wherein the insulation is foamed polyurethane.

11. A container as claimed in claim 9 wherein the composition in the heat sink has a melting point about 3° C. to 5° C. below the thermosensitive temperature of said goods.

12. A container as claimed in claim 9 wherein the salt is selected from the group consisting of sodium sulfate, sodium carbonate and calcium chloride.

13. A container as claimed in claim 12 wherein the hydrophilic bonding agent is fumed silicon dioxide.

14. A container as claimed in claim 9 wherein the goods are irreversible temperature indicators.

15. A container as claimed in claim 14 wherein the temperature indicators are single use thermometers.

16. A container as claimed in claim 9 wherein the heat sink is formed in a band which surrounds said goods.

17. A container as claimed in claim 9 wherein the insulation is polystyrene foam.

* * * * *

UNITED STATES PATENT AND TRADEMARK OFFICE

CERTIFICATE OF CORRECTION

PATENT NO. : 4,903,493

DATED : February 27, 1990

INVENTOR(S) : Willem Van Iperen, et al.

It is certified that error appears in the above-identified patent and that said Letters Patent is hereby corrected as shown below:

TITLE PAGE:

In the Abstract, line 6: "silcon" should read as --silicon--

Column 10, line 18: "if" should read as --is--

Column 10, line 23, Claim 8: "3° C. below the" should read as --3° to 5° C. below the--

Signed and Sealed this

Sixteenth Day of July, 1991

*Attest:*

HARRY F. MANBECK, JR.

*Attesting Officer*

*Commissioner of Patents and Trademarks*